US011377796B2

(12) United States Patent
Erkelenz

(10) Patent No.: US 11,377,796 B2
(45) Date of Patent: Jul. 5, 2022

(54) SEALING STRIP FOR SEALING A POSITIVE OR NEGATIVE PRESSURE ZONE OF A ROLLER, ROLLER WITH SUCH A SEALING STRIP, AND METHOD FOR OPERATING THE ROLLER

(71) Applicant: VOITH PATENT GMBH, Heidenheim (DE)

(72) Inventor: Marc Erkelenz, Neu-Ulm (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 17/251,375

(22) PCT Filed: Jun. 5, 2019

(86) PCT No.: PCT/EP2019/064592
§ 371 (c)(1),
(2) Date: Dec. 11, 2020

(87) PCT Pub. No.: WO2019/238482
PCT Pub. Date: Dec. 19, 2019

(65) Prior Publication Data

US 2021/0254284 A1 Aug. 19, 2021

(30) Foreign Application Priority Data

Jun. 11, 2018 (DE) ..... 10 2018 113 832.6

(51) Int. Cl.
*D21F 3/10* (2006.01)

(52) U.S. Cl.
CPC ..... *D21F 3/10* (2013.01)

(58) Field of Classification Search
CPC ..... D21F 3/10; D21F 7/00; D21F 1/50; F16J 15/3296
See application file for complete search history.

(56) References Cited

U.S. PATENT DOCUMENTS 9,708,768 B2 7/2017 Erkelenz et al.
10,113,647 B2 10/2018 Erkelenz et al.
(Continued)

FOREIGN PATENT DOCUMENTS

AT 516210 B1 4/2017
EP 2885457 A1 6/2015
(Continued)

*Primary Examiner* — Eric Hug
*Assistant Examiner* — Matthew M Eslami
(74) *Attorney, Agent, or Firm* — Laurence A. Greenberg; Werner H. Stemer; Ralph E. Locher

(57) ABSTRACT

A sealing device for sealing a positive or negative pressure zone of a roll for a machine for producing or processing a fibrous web includes a sealing strip and a lubricating device for introducing a lubricant between an inner surface of a roll shell and a sealing surface of the sealing strip when used as intended. The lubricating device includes a plurality of lubricant outlet openings and can be connected to a supply line for supplying lubricant. The lubricating device can be connected to the supply line through a plurality of inlets which are distributed over the length of the sealing strip. The sealing strip has a first and a second longitudinal-side end and the distance from at least one longitudinal-side end, preferably both longitudinal-side ends, to an inlet is at most 800 mm. A roll and a method for operating a roll are also provided.

16 Claims, 3 Drawing Sheets

(56) References Cited

U.S. PATENT DOCUMENTS

| | | | | |
|---|---|---|---|---|
| 10,184,214 | B2 * | 1/2019 | Keinberger | D21F 3/02 |
| 2015/0204014 | A1 * | 7/2015 | Erkelenz | F16C 13/00 277/300 |
| 2017/0159818 | A1 | 6/2017 | Erkelenz et al. | |

FOREIGN PATENT DOCUMENTS

| | | | |
|---|---|---|---|
| EP | 3022356 | B1 | 10/2018 |
| WO | 2014026914 | A1 | 2/2014 |

* cited by examiner

SEALING STRIP FOR SEALING A POSITIVE OR NEGATIVE PRESSURE ZONE OF A ROLLER, ROLLER WITH SUCH A SEALING STRIP, AND METHOD FOR OPERATING THE ROLLER

BACKGROUND OF THE INVENTION

Field of the Invention

The invention relates to a sealing device for sealing a positive or negative pressure zone of a roll for a machine for producing or processing a fibrous web, wherein the sealing device has a sealing strip and a lubricating device with which, when used as intended, a lubricant can be introduced between the inside of the roll shell and the sealing surface of the sealing strip, and the lubricating device includes a plurality of lubricant outlet openings and can be connected to a supply line supplying lubricant. The invention also relates to a roll for a machine for producing or processing a fibrous web including a positive or negative pressure zone, and a method for operating a roll.

Sealing devices in evacuated or blown rolls for paper, board or tissue machines must reliably seal off the positive or negative pressure zone against the surroundings in which normal pressure prevails. Here, to seal the positive pressure or negative pressure zone, the sealing surface of each sealing strip of the sealing device is set against the inside of the rotating roll shell. In order to reduce the wear of the sealing strip caused by friction between the lateral surface and the sealing surface, attempts are made to introduce lubricant between the sealing surface and the inside. This is usually done with spray pipes which, in the direction of rotation of the roll, are arranged upstream of the first sealing strip of the positive or negative pressure zone. Here, the lubricant applied to the inside of the roll shell is conveyed by the rotation of the latter to the individual sealing strips, as a result of which, as seen in the direction of rotation, the lubricant supply decreases from sealing strip to sealing strip. In order nevertheless to supply the sealing strips following in the direction of rotation with sufficient lubricant, a large quantity of lubricant has to be used, which, however, benefits only a small part of the actual lubrication of the sealing strips and otherwise contributes only to the undesired re-wetting of the fibrous web.

To solve this problem, EP 2 885 457 and EP 3 022 356 propose to conduct the lubricant directly to the upper side of the respective sealing strip providing the sealing surface, in order thereby to supply each individual sealing strip specifically with the necessary quantity of lubricant. A preferred refinement of this invention here also proposes a lubricant channel, which is provided on the upper side of the roll and which is in the form of a groove-like depression arranged next to the sealing surface and extending in the longitudinal direction of the sealing strip, i.e. in the cross-machine direction of the roll, if necessary with the aid of a suitable lip.

Irrespective of which type of lubricating device is used, it is essential for low-wear operation of such a roll that the sealing surface of the sealing strip is adequately supplied with lubricant over its entire length, which is frequently 10 m or more. However, as small a quantity of lubricant as possible should be used for this lubrication, for economic reasons.

For this purpose, it would be desirable to be able to ensure the most uniform distribution of the lubricant over the entire length of the sealing strip.

SUMMARY OF THE INVENTION

It is therefore an object of the invention to propose a sealing device and a roll having a sealing device in which a uniform supply of the sealing strip with lubricant is ensured. Furthermore, it is an object of the invention to indicate a reliable method for operating such a roll while using a small quantity of lubricant.

With regard to the devices, the object is completely achieved by a sealing device for sealing a positive or negative pressure zone of a roll for a machine for producing or processing a fibrous web as described below, and a roll for a machine for producing or processing a fibrous web as described below and, with regard to the method, by a method for operating a roll as described below.

Further advantageous embodiments are described in the sub-claims.

The object is achieved by a sealing device for sealing a positive or negative pressure zone of a roll for a machine for producing or processing a fibrous web, wherein the sealing device has a sealing strip and a lubricating device, by means of which, when used as intended, a lubricant can be introduced between the inside of the roll shell and the sealing surface of the sealing strip, and wherein the lubricating device comprises a plurality of lubricant outlet openings and can be connected to a supply line for the supply with lubricant. According to the invention, the sealing device is characterized in that the lubricating device can be connected to the supply line via a plurality of inlets, which are distributed over the length of the sealing strip, the sealing strip has a first and a second longitudinal end, and the spacing from at least one, preferably both, longitudinal ends to an inlet is at most 1000 mm, specifically at most 800 mm, in particular at most 600 mm, preferably 400 mm or less.

Such a sealing device may in particular be advantageous also to supply the edges of the sealing strip adequately and uniformly with lubricant. Over the greatest part of the length of the sealing strip, each point can be supplied with lubricant both from the left and from the right, since there is at least one inlet on both sides, via which the lubricating device is supplied with lubricant. In the edge regions of the sealing strip on the other side of the first and last inlet, however, the problem arises that these regions are supplied with lubricant only from one side, since there is an inlet only on one side. This can lead to the region of the longitudinal ends of the sealing strip not being supplied with sufficient lubricant, specifically also with less lubricant than the central region of the sealing strip.

Thus, provision can advantageously be made for the inlets to be arranged such that their spacing from one another in the longitudinal direction of the roll is less than 2 m, in particular less than 1.75 m, preferably 1.5 m or less. In particular, the inlets can also be arranged such that the spacing of adjacent inlets from one another in the longitudinal direction of the roll is equal or differs by no more than 500 mm from one another.

Preferably, the lubricating device can be provided wholly or partly in or on the sealing strip, wherein in particular the lubricant outlet openings can be in the sealing strip.

Furthermore, it may be advantageous if the spacing of at least one, preferably both, longitudinal ends to an inlet is at least 20 mm, in particular at least 50 mm. A spacing of 100 mm may also be advantageous. This is because if an inlet is too close to the longitudinal end of the sealing strip, it is possible for the effect to occur that the lubricant supplied goes beyond the end of the sealing strip. In order to prevent this, although the active width of this inlet can be kept low by means of a lower lubricant supply, this then leads to a further inlet having to be provided relatively close to this first inlet.

Furthermore, provision can be made for the lubricating device to be provided wholly or partly in or on the sealing strip, and wherein in particular the inlets are provided in the sealing strip. In this way, it is not necessary for any inlets to be provided in particular in the sealing strip holder.

With regard to the roll, the object is achieved by a roll which comprises at least one sealing device according to an aspect of the invention.

The lubricant used can normally be a water, to which additives can be added if appropriate. The pressure in the supply line can be, for example, between 2 and 8 bar, in particular 3 bar to 6 bar.

A further idea which, even taken on its own, involves an inventive step but can also be used in combination with a sealing device according to one aspect of the invention, relates to a roll for a machine for producing or processing a fibrous web, which comprises a movable roll shell and a positive or negative pressure zone which is arranged within the roll shell and is fixed against rotation relative to the roll shell, and a sealing device for sealing the positive or negative pressure zone with respect to the surroundings. The sealing device has a sealing strip and a lubricating device, by means of which the lubricant can be introduced between the inside of the roll shell and the sealing surface of the sealing strip, wherein the lubricating device comprises a plurality of lubricant outlet openings and is connected via multiple inlet segments to a supply line for the supply with lubricant. The roll is characterized in that the supply line comprises an inner section which extends within the roll shell, and this inner section has a storage volume of at least 500 $cm^3/m$, in particular of at least 750 $cm^3/m$ or 1000 $cm^3/m$, based on the length of the sealing strip.

An inlet segment is intended to be understood to be a line part which is connected to the supply line which supplies the entire lubricating device, and conducts lubricant to some of the lubricant outlet openings.

The sealing device of this roll can be designed as a sealing device according to an aspect of the invention. The inlet segments can be connected to the inlets of the sealing device according to an aspect of the invention.

However, such a roll is also advantageous for other sealing devices, independently thereof.

Trials by the applicant have surprisingly shown that, with such a supply line of the sealing device, a uniform lubricant distribution can be implemented. As a result of the buffering action of the comparatively large storage volume of the supply line, it is possible to ensure that all the inlet segments are supplied with the same pressure, or the pressure difference is at least so small that it has no noticeable influence on the distribution of the lubricant. This represents a significant difference from the rolls known from the prior art. There, a thin supply line is usually led into the roll from one side and the inlet segments to the lubricating device branch off from this supply line. This leads to a noticeably lower pressure being present in the inlet segments that are located further back in the flow direction of the lubricant, or a smaller quantity of lubricant being supplied to the lubricating device. This effect is largely avoided by the storage volume in the present roll.

The size of the storage volume should be at least 500 $cm^3/m$. The value of 500 $cm^3/m$ is adequate for the quantities of lubricant that are usually used of 0.5 l/m/min to about 3 l/m/min. Larger storage volumes of 1000 $cm^3/m$, 2000 $cm^3/m$ or more are advantageous for reasons of evening out the pressure as described above. On account of the quite narrow installation space in some rolls or also for economic reasons, it may be expedient to limit the size of the storage volume upward. Thus, it may be advantageous to provide the storage volume to be no greater than 20,000 $cm^3/m$ or than 10,000 $cm^3/m$.

The statement of the storage volume in "$cm^3/m$" in each case refers to the length of the lubricated sealing strip. The roll can advantageously be designed as a suction roll. In such suction rolls, the roll shell has openings which are usually arranged in the form of a regular pattern. Thus, by means of the negative pressure prevailing in the negative pressure zone, water can be sucked out of a fibrous web or clothing through the openings in the roll shell.

In an advantageous embodiment of the further idea, provision can be made for the inner section to comprise a pipe-shaped part or to consist thereof, which extends substantially over the entire length of the sealing strip, wherein this pipe has an internal diameter of 25 mm or more at at least one point, in particular more than 40 mm, preferably 50 mm or more. To be most economical, recourse is gladly made to standard pipe sizes, for example 1-inch, 1.5-inch and 2-inch pipes. Such an embodiment is advantageous since, in this way, two properties of the supply line are simultaneously fulfilled, namely the distribution of the lubricant over the length of the roll and the sealing strip and the provision of the storage volume. In particular, provision can advantageously be made for the pipe to have a constant cross section over more than 50% of its length, in particular over its entire length. A pipe which has an internal diameter of 25 mm over the entire length already provides, for example, more than 500 $cm^3/m$ of storage volume. In another advantageous embodiment, provision can be made for the pipe to taper continuously over its length. Such an embodiment can be advantageous in particular in the case of long sealing strips of more than 5 m or more than 10 m, in order to keep the pressure still further constant on inlet segments placed downstream in the flow direction of the lubricant.

In preferred embodiments, provision can further be made for the plurality of the lubricant outlet openings to be distributed uniformly over the length of the sealing strip and, in particular, for the spacings of adjacent lubricant outlet openings to differ by less than 25%. In addition to the uniform supply of the inlet segments, a distribution of the lubricant outlet openings of this type also assists the uniform distribution of the lubricant over the entire length of the sealing strip.

Advantageously, the spacing of two adjacent lubricant outlet openings can be between 20 mm and 200 mm, in particular between 30 mm and 100 mm. In particularly preferred embodiments, the spacing of adjacent lubricant outlet openings is between 40 mm and 60 mm.

Alternatively or additionally, provision can be made for the inlet segments to be arranged such that their spacing from one another in the longitudinal direction of the roll is less than 2 m, in particular less than 1.75 m, preferably 1.5 m or less. In particular, the inlet segments can also be arranged such that the spacing of adjacent inlet segments from one another in the longitudinal direction of the roll is equal.

The lubricating device can be implemented, for example, by lubricant being guided from the inlet segments to nozzle devices, for example fan nozzles, which represent the lubricant outlet openings. Via the nozzles, the lubricant is spread in the direction of the sealing surface to be lubricated. These nozzle devices are known as lubricating spray pipes and are usually arranged upstream of the sealing strip in the direction of rotation of the roll.

However, it may also be advantageous for the lubricating device to be provided wholly or partly in or on the sealing strip, wherein in particular the lubricant outlet openings are located in the sealing strip. Sealing strips of this type with an integrated lubricating device are frequently preferred since the lubrication of the sealing surface can be implemented with a smaller quantity of lubricant.

Provision can also be made for the inner section to be designed to be at least partly rigid. Here, the term "rigid" is to be understood in comparison with the inlet segments. Frequently, inlet segments are designed wholly or at least partly as a plastics hose. This is expedient in particular in sealing strips with an integrated lubricating device, since the inlet segment must move together with the movement of the strip caused by the wear. For reasons of stability and simpler handling, it may be advantageous if the inner section of the supply line is at least partly made from a rigid material, e.g. in the form of a metallic pipe or a plastics pipe.

Frequently, sealing devices have a so-called holder for holding the sealing strip. In a preferred embodiment, provision can be made for the inner section to extend at least partly on or in this holder.

In preferred embodiments, provision can be made for all the inlet segments to have the same length or to differ by less than 25% in their length. In the event of excessively large differences in the lengths of the inlet segments, there may be the danger that the action of evening out the pressure cannot be passed on completely as far as the lubricant outlet openings.

Advantageously, the length of the inlet segments can be between 150 mm and 700 mm, in particular between 200 mm and 400 mm.

It is a very advantageous embodiment here if the inner section of the supply line is mounted on the outside of the suction box of a negative pressure zone. Firstly, this mounting position is more easily accessible than in the interior of the suction box. Secondly, the distance from the inner section of the supply line to the inlets of the sealing strip is usually smaller, so that it is possible to manage with shorter inlet segments having a length of, for example, 150 mm-250 mm.

The spacing of an inlet segment from an end of the sealing strip on the longitudinal side can preferably be at most 1000 mm or at most 800 mm, in particular at most 600 mm, preferably 400 mm or less.

Furthermore, it may be advantageous if the supply line additionally has an outer section, which extends substantially outside the roll, wherein the outer section, having an internal diameter of 25 mm or less, in particular 20 mm or less, or 15 mm or less, is guided via an end face into the interior of the roll, where it is connected to the inner section. In particular, the outer section can have a lower internal diameter than the inner section, in particular also at the connecting point of the two sections.

With regard to the method, the object is achieved by a method for operating a roll for a machine for producing or processing a fibrous web, wherein the roll is designed according to one of the invention, characterized in that the lubricating device is supplied with less than 2.4 l/min/m, in particular between 0.4 l/min/m and 1.5 l/min/m, of lubricant. Given such a quantity of lubricant, the roll according to one of the aforementioned aspects proves to be particularly advantageous.

Furthermore, it may be advantageous if, over a starting time period, the lubricating device is supplied with 2.4 l/min/m or more of lubricant and, after this starting time period, the quantity of lubricant is reduced to less than 2.4 l/min/m, in particular between 0.4 l/min/m and 1.5 l/min/m.

Such a starting time period can be, for example, at least 30 s, in particular between 30 s and 5 min. Such a starting time period, which precedes the standard operation, can ensure, amongst other things, that the storage volume is completely filled with lubricant and thus the roll and the lubricating device can develop their full action. This is advantageous in particular in those rolls in which an inner section of the supply line has a storage volume which, as specified in the further idea, is at least 500 $cm^3$/m.

The invention will be explained in more detail below by using schematic drawings, the invention not being restricted to these embodiments.

DETAILED DESCRIPTION OF THE INVENTION

Figure 1:
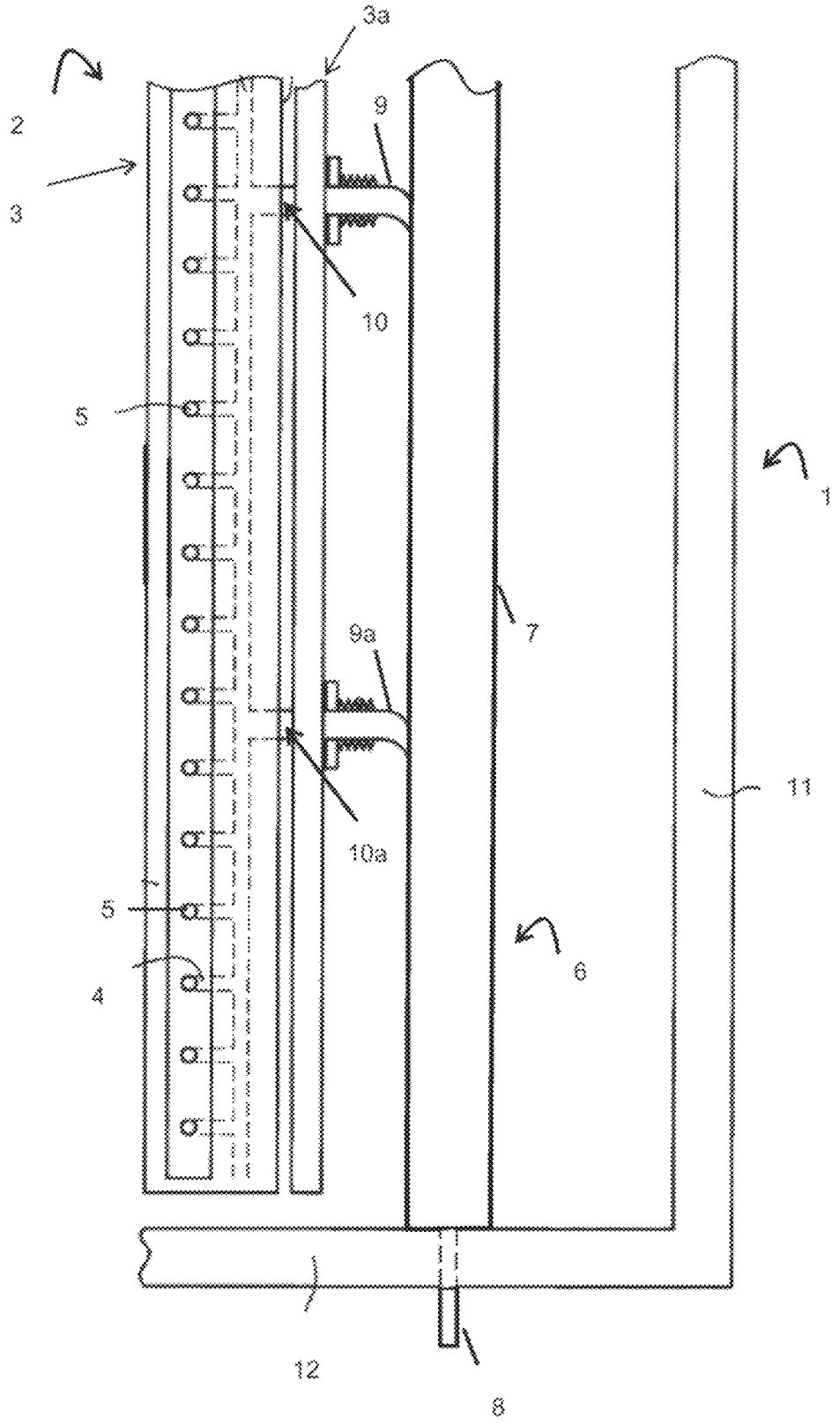
FIG. 1 shows a detail of a roll according to one aspect of the invention

FIG. 1 shows a roll 1 having a roll shell 11 and an end face 12. Such a roll can be, for example, a suction roll 1. A sealing device 2 is provided in the interior of the roll 1. The former comprises a sealing strip 3, which is arranged in a sealing strip holder 3*a*, and a lubricating device 4. The lubricating device 4 shown in FIG. 1 is largely located in the sealing strip 3. A multiplicity of lubricant outlet openings 5 are arranged beside one another. These openings 5 are placed such that the emerging lubricant gets between the sealing surface of the sealing strip 3 and the roll shell 11. For the supply of the lubricating device 4 with lubricant, e.g. with lubricating water, a supply line 6 is provided, which comprises an inner section 7 which extends in the interior of the roll shell 11, and has a storage volume of at least 500 $cm^3$/m, in particular of at least 2000 $cm^3$/m, based on the length of the sealing strip, and an outer section 8. Via a plurality of inlet segments 9, 9*a*, the lubricating device 4 is connected to the inner section 7 of the supply line 6 at a plurality of inlets 10, 10*a*. In advantageous embodiments, the spacings of two adjacent inlet segments 9, 9*a* and/or two adjacent inlets 10, 10*a* can each be equal. Alternatively or additionally, provision can also be made for the inlet segments 9, 9*a* to be arranged such that their spacing from one another in the longitudinal direction of the roll 1 is less than 2 m, in particular less than 1.75 m, preferably 1.5 m or less. The spacing of an inlet segment 9*a* or an inlet 10*a* from a longitudinal end of the sealing strip 3 can preferably be at most 800 mm, in particular at most 600 mm, preferably 400 mm or less.

The inner section 7 of the supply line in FIG. 1 comprises a pipe-shaped part. This pipe advantageously be made of a material (e.g. metal or plastic) which is more rigid than the inlet segments 9, 9*a*. It is possible, for example, to use pipes having internal diameters of 25 mm (corresponding to a storage volume of about 500 $cm^3$/m), 40 mm or 50 mm (corresponding to storage volume of about 2000 $cm^3$/m). The inlet segments 9, 9*a* can be designed, for example, as hose segments.

Figure 2:
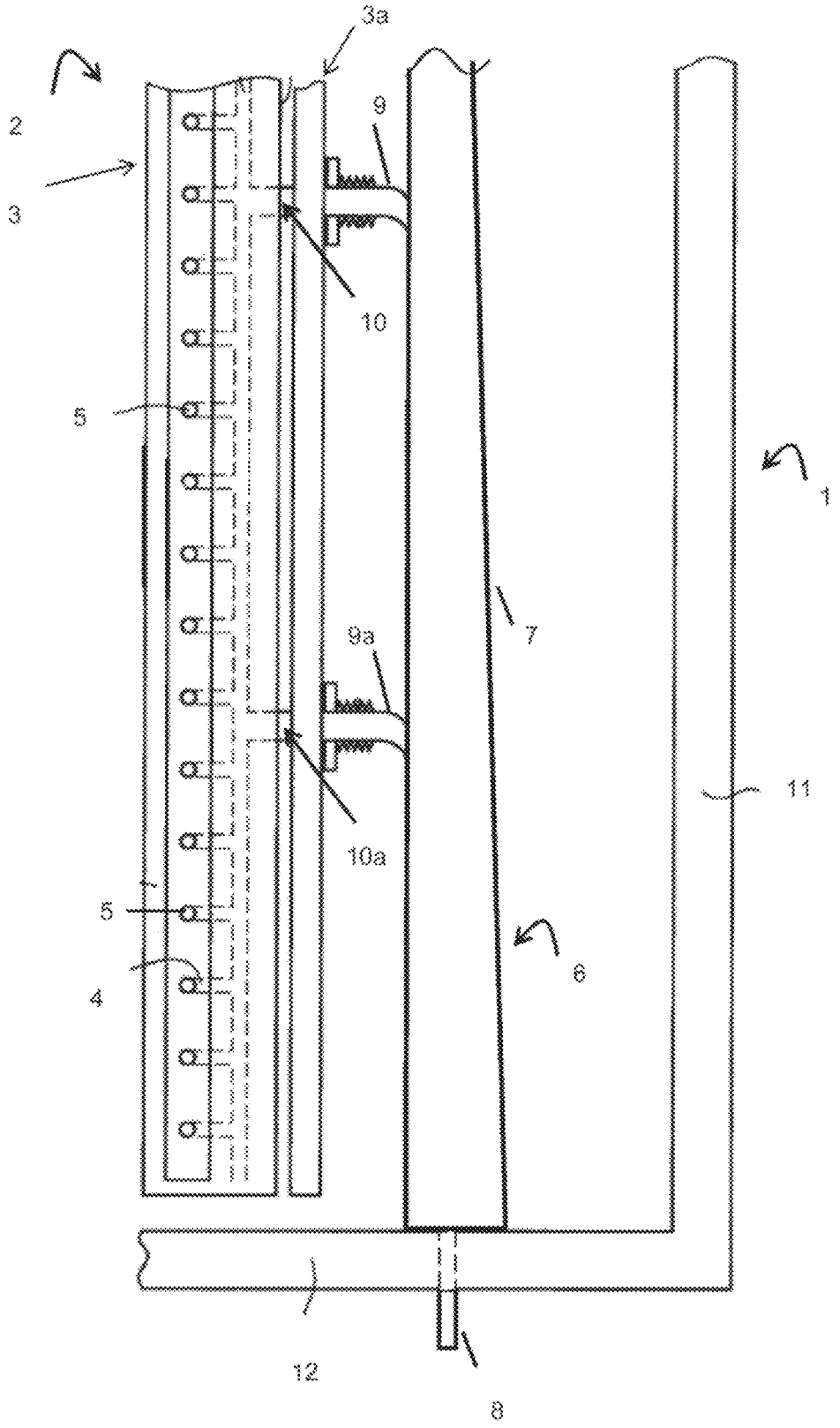
FIG. 2 shows a detail of a roll according to a further aspect of the invention in which an inner section of a supply line tapers continuously over its length.

FIG. 2 differs from FIG. 1 in that the inner section 7 consists of a pipe 7 which tapers continuously over its length.

Figure 3:
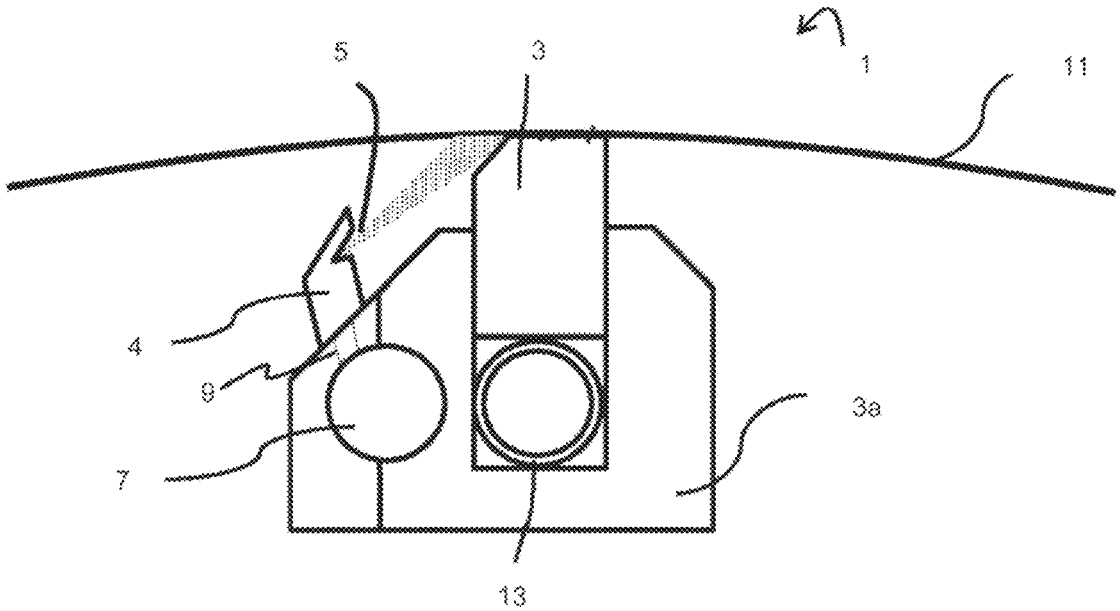
FIG. 3 shows an enlarged a detail of a roll according to a further aspect of the invention showing a sealing strip disposed in a holder and pressed against the inside of a roll shell.

FIG. 3 shows a sealing strip 3 in a holder 3*a*, which is pressed against the inside of the roll shell 11 of the roll 1 by means of a pressure hose 13. Such a use of a pressure hose for pressing onto a moving surface such as a roll shell is a measure which is usual and known to those skilled in the art. As distinct from the embodiments shown in FIGS. 1 and 2, in FIG. 3 the lubricating device 4 is not integrated into the sealing strip. The lubrication is implemented by means of a number of spray nozzles, which provide the outlet openings 5. The spray nozzles are connected to the inner section 7 of the supply line via inlet segments 9.

A further advantageous feature which, in FIG. 3, is implemented together with the spray nozzles but which is also possible in combination with a lubricating device 4 integrated into the sealing strip 3, consists in the inner section 7 of the supply line extending at least partly at least partly on or in the sealing strip holder 3*a*. This inner section 7 provides the storage volume of at least 500 $cm^3$/m, and can, for example, have the form of a cylinder or a tapering cylinder.

Figure 4:
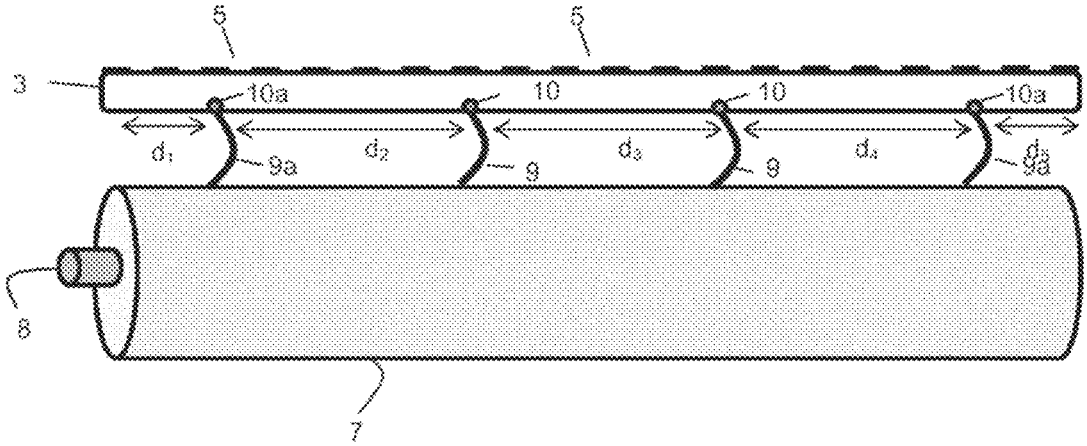
FIG. 4 shows a detail of a roll according to a further aspect of the invention indicating spacings between the inlets and distances between the inlets and the ends of the sealing strip.

In FIG. 4, essential components of the invention are illustrated, once more schematically. In a sealing strip 3 with an integrated sealing device, the lubricant outlet openings 5 are supplied with lubricant via inlets 10, 10*a*. The inlets 10, 10*a* are connected to the inner section 7 of the supply line via inlet segments 9, 9*a*. The spacings of the longitudinal end of the sealing strip 3 from the first inlet 10*a* and from the first inlet segment 9*a* are designated by d1 and d5, while the spacings of adjacent inlets 10, 10*a* and adjacent inlet segments 9, 9*a* from one another are designated by d2, d3, d4. The number of four inlets here is exemplary. It is entirely possible for more or fewer inlets/inlet segments to be provided The following table indicates some advantageous spacings of the inlet segments and the inlets.

| Example no. | $d_1$ | $d_2$ | $d_3$ | $d_4$ | $d_5$ |
|---|---|---|---|---|---|
| #1 | 400 mm | 1360 mm | 1360 mm | 1360 mm | 400 mm |
| #2 | 640 mm | 1200 mm | 1200 mm | 1200 mm | 640 mm |
| #3 | 540 mm | 1250 mm | 1300 mm | 1250 mm | 540 mm |

As it can be seen, the "inner" spacings d2-d4 can be equal or differ by a few millimeters. This can be necessitated, for example, by the installation situation.

LIST OF DESIGNATIONS

1 Roll
2 Sealing device
3 Sealing strip
3*a* Holder
4 Lubricating device
5 Lubricant outlet openings
6 Supply line
7 Inner section
8 Outer section
9, 9*a* Inlet segment
10, 10*a* Inlet
11 Roll shell
12 End face
13 Pressure hose

The invention claimed is:

1. A sealing device for sealing a positive or negative pressure zone of a roll or a machine for producing or processing a fibrous web, the sealing device comprising:

a supply line for supplying a lubricant;

a sealing strip having a sealing surface, first and second longitudinal ends, a length, and a plurality of mutually adjacent inlets distributed over said length of said sealing strip and spaced apart by distances therebetween;

one or both of said longitudinal ends of said sealing strip each being spaced apart from a respective one of said inlets by at least 20 mm and at most 1000 mm;

each longitudinal end being supplied by a respective one of said inlets being closer to said longitudinal end than said distances between said mutually adjacent inlets; and a lubricating device to be connected through said plurality of inlets to said supply line for introducing the lubricant between an inner surface of a roll shell of the roll and said sealing surface of said sealing strip during operation, said lubricating device having a plurality of lubricant outlet openings.

2. The sealing device according to claim 1, which further comprises one or both of said longitudinal ends of said sealing strip each being spaced apart from a respective one of said inlets by at least 50 mm and at most 800 mm.

3. The sealing device according to claim 1, which further comprises one or both of said longitudinal ends of said sealing strip each being spaced apart from a respective one of said inlets by 600 mm or less.

4. The sealing device according to claim 1, wherein said lubricating device is provided wholly or partly in or on said sealing strip or said lubricant outlet openings are formed in said sealing strip.

5. The sealing device according to claim 1, wherein said sealing strip has a longitudinal direction, and said inlets are spaced apart from one another in said longitudinal direction of said sealing strip by less than 2 m.

6. The sealing device according to claim 1, wherein said sealing strip has a longitudinal direction, and said inlets are spaced apart from one another in said longitudinal direction of said sealing strip by less than 1.75 m.

7. The sealing device according to claim 1, wherein said sealing strip has a longitudinal direction, and said inlets are spaced apart from one another in said longitudinal direction of said sealing strip by 1.5 m or less.

8. The sealing device according to claim 1, wherein said sealing strip has a longitudinal direction, said inlets include adjacent inlets, and said adjacent inlets are separated from one another in said longitudinal direction of said sealing strip by spacings being identical or differing by no more than 500 mm from one another.

9. The sealing device according to claim 1, wherein said lubricating device is provided wholly or partly in or on said sealing strip or said inlets are provided in said sealing strip.

10. A roll for a machine for producing or processing a fibrous web, the roll comprising:

a positive or negative pressure zone; and a sealing device according to claim 1 for sealing said positive or negative pressure zone.

11. A method for operating a roll for producing or processing a fibrous web, the method comprising:

providing a roll according to claim 10; and supplying said lubricating device with less than 2.4 l/min/m of lubricant.

12. The method according to claim 11, which further comprises supplying the lubricating device with between 0.4 l/min/m and 1.5 l/min/m of lubricant.

13. The method according to claim 11, which further comprises:

supplying said lubricating device with 2.4 l/min/m or more of lubricant over a starting time period; and reducing the quantity of lubricant, after the starting time period, to less than 2.4 l/min/m.

14. The method according to claim 13, which further comprises reducing the quantity of lubricant, after the starting time period, to between 0.4 l/min/m and 1.5 l/min/m.

15. The method according to claim 13, wherein the starting time period is at least 30 seconds.

16. The method according to claim 13, wherein the starting time period is between 30 seconds and 5 min.

* * * * *